United States Patent [19]

Berry

[11] Patent Number: 4,700,786

[45] Date of Patent: Oct. 20, 1987

[54] DRAG-TYPE ROAD GRADER

[75] Inventor: Vernon D. Berry, Winona, Kans.

[73] Assignee: Logan Western Road, Inc., Winona, Kans.

[21] Appl. No.: 809,270

[22] Filed: Dec. 16, 1985

Related U.S. Application Data

[63] Continuation-in-part of Ser. No. 616,680, Jun. 14, 1984, Pat. No. 4,568,219.

[51] Int. Cl.[4] ..... E02F 3/76

[52] U.S. Cl. ..... 172/799.5; 172/780; 172/795; 172/784; 172/796; 404/118

[58] Field of Search ..... 172/787, 784, 780, 799.5, 172/684.5, 779, 781, 795, 796, 509; 404/418, 420

[56] References Cited

U.S. PATENT DOCUMENTS

| | | | |
|---|---|---|---|
| 981,437 | 1/1911 | Linder | 172/787 |
| 1,185,090 | 5/1916 | Hall | 172/787 |
| 1,303,415 | 5/1919 | Thurston | 404/118 |
| 1,476,263 | 12/1923 | Martin | 172/799.5 |
| 1,773,431 | 8/1930 | Mosel | 404/120 X |
| 1,812,296 | 6/1931 | Jarmin | 172/787 |
| 1,845,324 | 2/1932 | Noffsinger et al. | 172/780 |
| 1,994,437 | 3/1935 | Reis | 172/784 |
| 2,348,445 | 5/1944 | Bayer | 405/85 |
| 2,593,880 | 4/1952 | Heavlin | 172/780 |
| 2,646,850 | 7/1953 | Brown | 172/780 |
| 3,276,153 | 10/1966 | Sorensen | 172/387 |
| 3,435,546 | 4/1969 | Iverson | 172/780 |
| 3,883,259 | 5/1975 | Berg et al. | 404/120 |

FOREIGN PATENT DOCUMENTS

| | | | |
|---|---|---|---|
| 1024726 | 4/1953 | France | 404/120 |
| 1320899 | 6/1973 | United Kingdom | 404/118 |

*Primary Examiner*—Richard J. Johnson

*Attorney, Agent, or Firm*—Litman, Day & McMahon

[57] ABSTRACT

A drag-type road grader including a skewable frame and a plurality of blade assemblies extending transversely across the frame. A tongue assembly is mounted on the frame and includes hydraulic cylinders for skewing the frame to alternative parallelogram-shaped configurations whereby the blade assemblies are angled with respect to the direction of travel. Retractible wheel assemblies are provided for transporting the grader in a non-working mode.

16 Claims, 19 Drawing Figures

16.
16.

DRAG-TYPE ROAD GRADER

CROSS REFERENCE TO RELATED APPLICATION

This application is a continuation-in-part of application Ser. No. 616,680, filed June 14, 1984, which is now U.S. Pat. No. 4,568,219.

BACKGROUND OF THE INVENTION

1. Field of the Invention

The present invention relates generally to road grading equipment and in particular to a drag-type road grader.

2. Description of the Prior Art.

Nonpaved roads comprising dirt, gravel and the like generally require periodic maintenance to repair the damage done thereto by vehicular traffic. A common maintenance procedure is to regrade and relevel the roads with equipment especially designed for this purpose. For example, self-propelled road graders are well known and may be provided with blades for scraping, leveling and reshaping a road surface. The blades are generally adjustably mounted with respect to height, pitch and angle relative to the direction of travel. For road grading purposes, the blades are usually oriented at an oblique angle with respect to the direction of travel so that excess road material flows transversely.

However, such self-propelled, conventional road graders have several drawbacks for the maintenance of roads comprising dirt, gravel and the like. First of all, generally only a single blade is mounted thereon. The single blade performs both cutting and filling operations wherein material is respectively removed from the high spots and deposited in the low spots. The only packing and compression of such redistributed material which occurs is by the rear wheels of the vehicle. Therefore, only the fractional portion of the blade's swath directly in the path of the vehicle rear wheels is compacted.

Secondly, self-propelled road graders operate best on relatively dry roads because their blades tend to stick in damp road materials. However, dry, loose material is susceptible to being blown out of level before being compacted by vehicular traffic. For example, pot holes filled under dry conditions with a single-blade road grader may be emptied and reopened by a high wind.

Yet another disadvantage of conventional, self-propelled road graders is their slow operating speeds. Excessive blade vibration or "chatter" typically occurs at speeds of approximately four miles per hour. The relatively slow operating speeds of such equipment tend to increase the cost of road maintenance therewith through such factors as labor, equipment usage, fuel consumption, maintenance and the amount of equipment required to maintain a given road network.

Drag-type road graders are also well known and are pulled along roads by tractors and the like. In fact, such drag-type road graders may be successfully employed in combination with self-propelled, single-blade road graders since the addition of the former can help compensate for the deficiencies of the latter. An exemplary drag-type road grader is shown in the Hall U.S. Pat. No. 1,185,090 and comprises a rectangular frame with a pair of blades extending thereacross at oblique angles. The Thurston U.S. Pat. No. 1,303,415 shows a frame with transverse blades. The frame members of the Thurston device are pivotally connected whereby the frame may be skewed to form a parallelogram to adjust the angles of the blades with respect to the direction of travel.

SUMMARY OF THE INVENTION

In the practice of the present invention, a road grader is provided which includes a frame having a pair of parallel, longitudinal trusses interconnected by rectangular subframes. Each subframe is pivotally connected to the trusses and includes a blade assembly. A tongue assembly extends along the direction of travel and the longitudinal axis of the grader and includes power cylinders for skewing the frame to parallelogram-shaped configurations by longitudinally shifting the trusses relative to each other and by rotating the subframes with respect to the trusses. The subframes are pivotally connected to the frame trusses by a plurality of hinge mechanisms with vertical, pivotal axes. A pair of wheel assemblies are retractably mounted on the frame for transporting the grader in a non-working mode.

A hydraulic blade lift mechanism for the road grader includes T-shaped rocker members pivoted on inner members of the frame hinge assemblies associated with one of the grader blades. The rockers on each side are connected by scissor arms, and a hydraulic ram connects with the scissor arms such that extension and retraction of the ram levers the blade vertically. Ball sockets are provided in the linkage between the rocker members and the outer members of the hinge assemblies to allow skewing of the frame.

Road material deflector plates are mounted on stringers pivotally connected to the blade assemblies. The deflector plates control the lateral dispersal of road surface material scraped up by the blades to better fill in depressions on the road surface.

OBJECTS OF THE INVENTION

The objects of the present invention are: to provide a drag-type road grader; to provide such a grader for roads comprising dirt, gravel and the like; to provide such a grader which is well adapted for working relatively damp roads; to provide such a grader with a plurality of transverse blades; to provide such a grader with a frame which may be skewed to angle the blades a desired amount relative to the direction of travel; to provide such a grader which includes a blade for compacting redistributed material; to provide such a grader which includes a hydraulic system for skewing its frame; to provide such a grader which includes retractable wheels for towing in a non-working mode; to provide such a grader wherein the blades are independently and vertically adjustable; to provide a mechanism for hydraulically adjusting the height of one of the blades; to provide such a grader which is efficient in operation, economical to manufacture, capable of a long operating life, and generally well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

Figure 3:
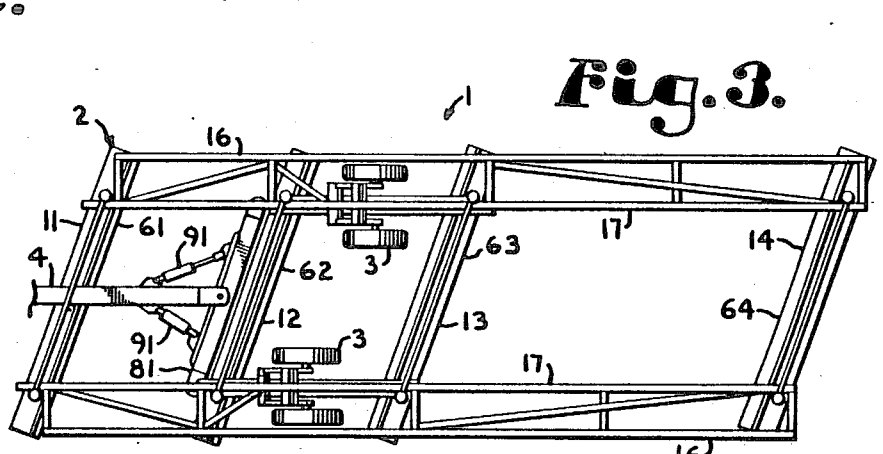
FIG. 3 is a top plan of the road grader in a second skewed configuration.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates a road grader embodying the present invention. The road grader 1 generally comprises a distortable frame 2, a pair of retractable transport wheel assemblies 3 and a tongue assembly 4. First, second, third and fourth blade assemblies 11, 12, 13 and 14 respectively extend transversely across the frame 2. The frame 2 includes a pair of longitudinal trusses 16 each having upper, lower and outer rails 17, 18 and 19 rigidly interconnected by chords 20. The outer rails 19 are spaced equidistantly from the upper and lower rails 17 and 18 and form triangular configurations therewith when viewed from the end.

Figure 8:
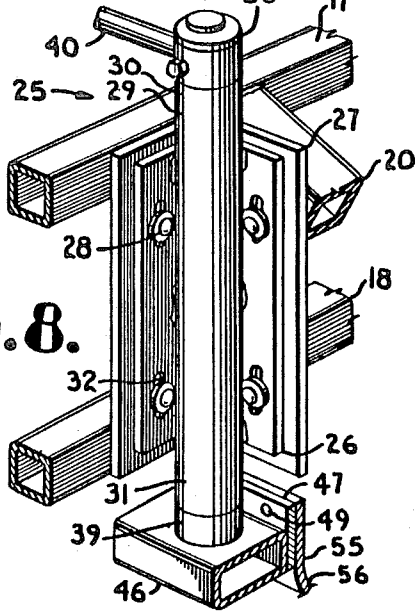
FIG. 8 is a fragmentary perspective of the road grader particularly showing a hinge assembly.

A plurality of hinge and blade depth adjustment assemblies 25 are mounted on each truss above respective ends of the blade assemblies 11, 12, 13 and 14. Each hinge assembly 25 includes inner and outer angle members 26, 27 (FIG. 8). The outer angle members 27 are welded to respective upper and lower rails 17, 18 and chords 20 at the intersections thereof and include four receivers for blade assembly mounting bolts 28.

Figure 12:
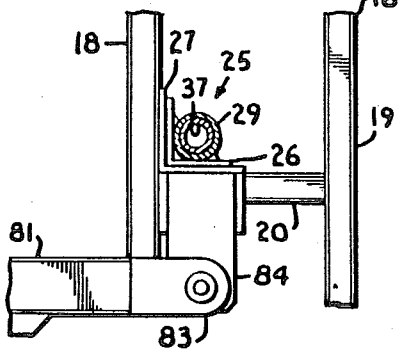
FIG. 12 is a fragmentary horizontal sectional view taken on line 12—12 of FIG. 5 and illustrates details of a hinge assembly.
Figures 13, 14, 15:
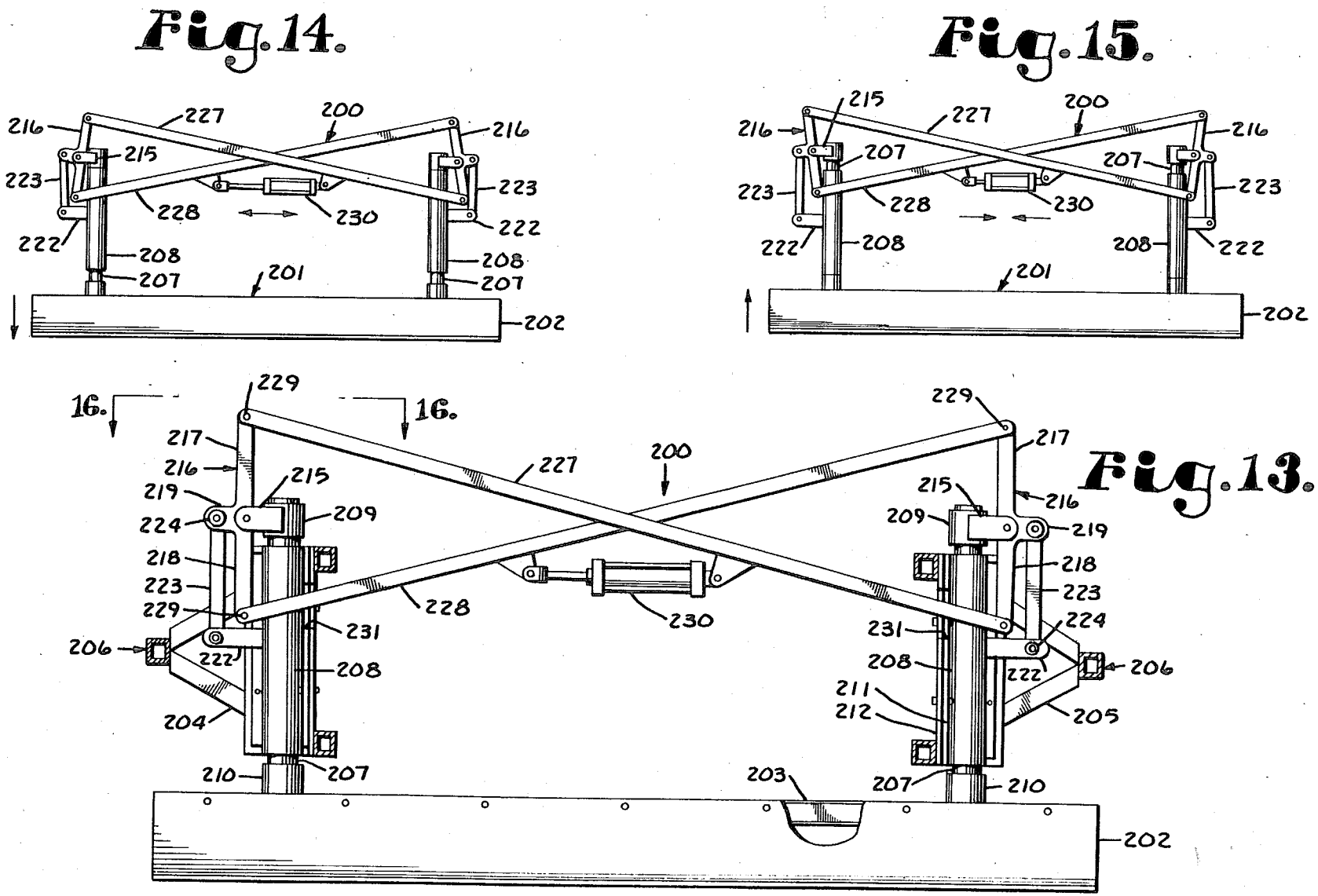
FIG. 13 is a transverse sectional view of a modified road grader frame incorporating a hydraulic scissor lift mechanism for one of the grader blades.
FIG. 14 is a view similar to FIG. 13 at a reduced scale and illustrates the grader blade in a fully lowered position.
FIG. 15 is a view similar to FIG. 14 and illustrates the grader blade in a fully raised position.

The inner angle member 26 of each hinge assembly 25 is welded to a respective upright hinge tube 29 with upper and lower ends 30, 31 protruding above and below respective upper and lower rails 17, 18. The inner angle member 26 includes a plurality of elongated slots 32 for receiving the bolts 28 whereby the angle members 26, 27 are vertically adjustably connected. A hinge pin 37 (FIG. 12) comprising, for example, a length of hollow pipe having an outside diameter slightly less than the inside diameter of the hinge tube 29 is inserted in the latter and rotatable with respect thereto about a vertical axis. Upper and lower collars 38, 39 are mounted on the hinge pin 37 at the upper and lower ends 30, and 31 respectively. The upper collars 38 of the four transversely aligned pairs of hinge assemblies 25 are interconnected by four tie rods 40.

Figure 11:
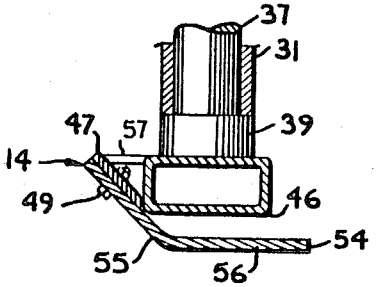
FIG. 11 is a fragmentary, vertical cross section of the road grader particularly showing a compacting blade.

Each blade assembly 11, 12, 13 and 14 includes a respective transverse torque tube 46 (FIG. 8) having a rectangular cross-sectional configuration. Each torque tube 46 is welded to a respective pair of lower collars 39. Blade mounting bars 47 (FIG. 11) are welded to the torque tubes 46 and include longitudinally spaced receivers for blade mounting bolts 49.

Figure 1:
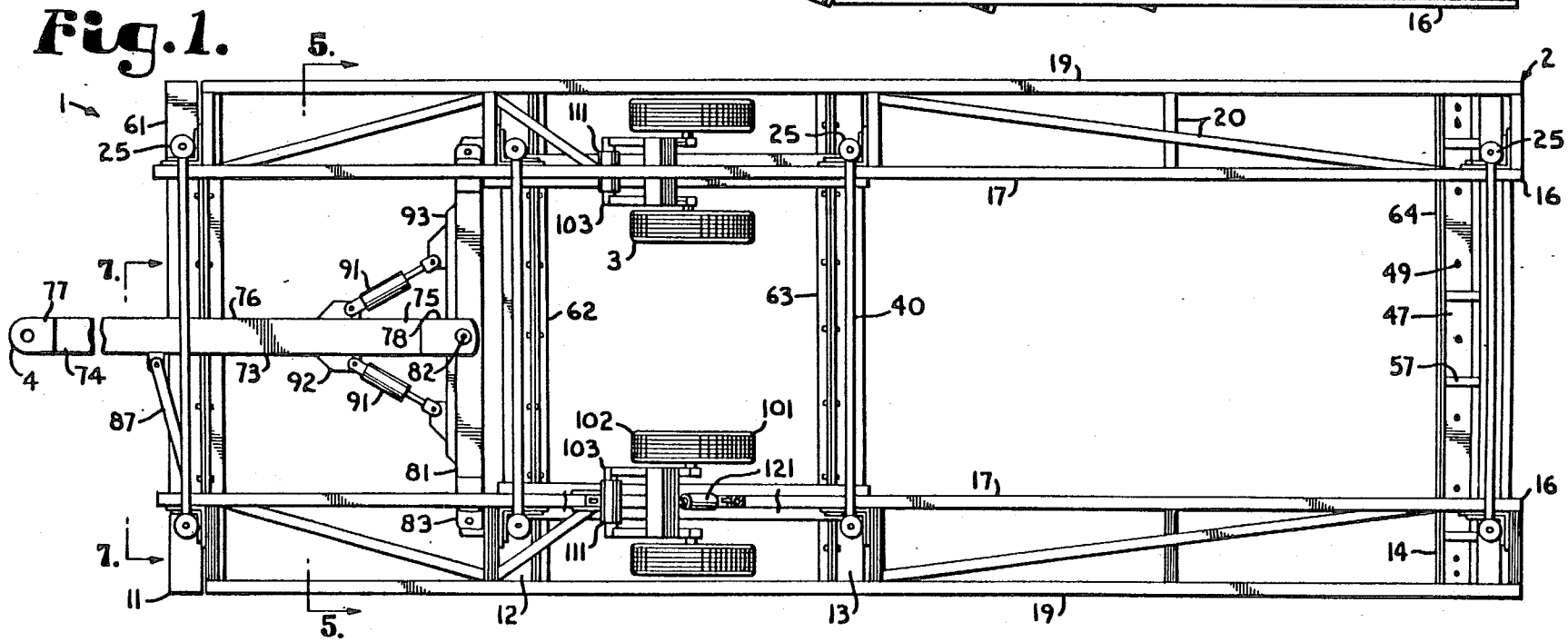
FIG. 1 is a top plan of a road grader according to the present invention.

First, second, third and fourth blades 51, 52, 53 and 54 (FIG. 4) are bolted on the blade mounting bars 47 of respective blade assemblies 11–14. Each blade 51–54 includes a proximate leg 55 with longitudinally spaced receivers for the bolts 49 and a distal leg 56 forming an obtuse angle with respect to the proximate leg 55. Although the blade mounting bars 47 and the blades 51–54 are substantially identical, they are mounted on the blade assemblies 11–14 in different orientations for performing different functions. The first and second blades 51, 52 are oriented as shown in FIG. 1 for scraping with their distal legs 56 extending downwardly and rearwardly. The blade mounting bars 47 of the blade assemblies 11, 12 are welded on rear faces of respective torque tubes 46.

The blade mounting bar 47 of the third blade assembly 13 is welded on the front of the torque tube 46. The third blade 53 functions as a cutter and is bolted to the blade mounting bar 47 with its distal leg 56 extending forwardly, that is, in the direction of travel. The blade mounting bar 47 of the fourth blade assembly 14 is welded to a respective torque tube 46 along the bottom edge of its front face and slopes upwardly and forwardly therefrom forming an upwardly open acute angle with the front face of the torque tube 46. Spacers 57 (FIG. 11) are welded to the upper edge of the torque tube front face and to the blade mounting bar 47 of the fourth blade assembly 14. The fourth blade 54 is bolted to the blade mounting bar 47 with its proximate leg 55 sloping downwardly from front to back and its distal leg 56 substantially horizontal and positioned beneath the torque tube 46. The fourth blade 54 functions to compact and smooth the material scraped and cut by the preceeding blades 51, 52 and 53.

Figure 10:
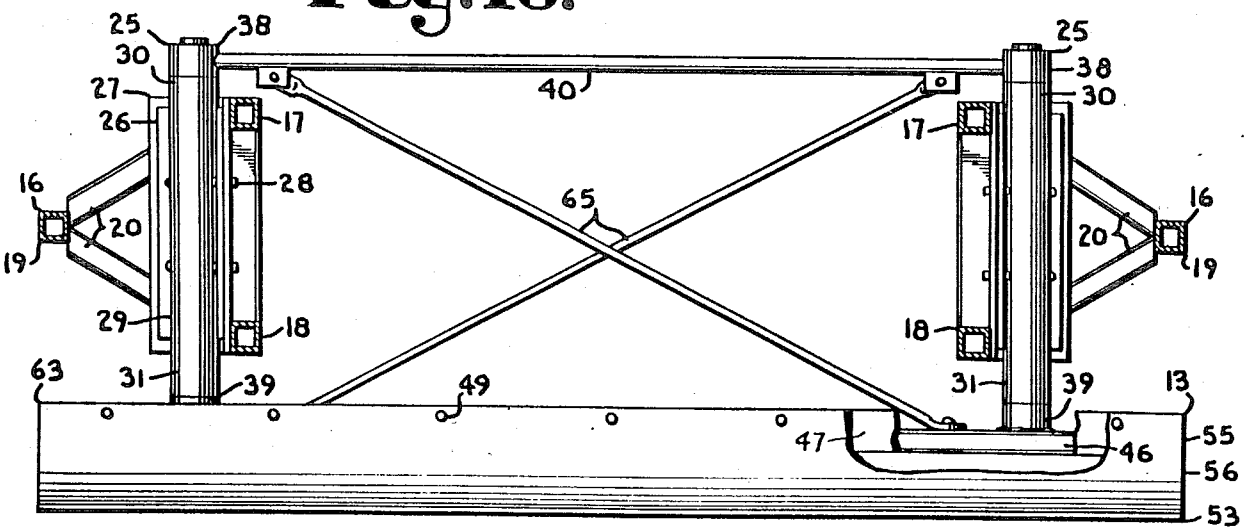
FIG. 10 is a vertical cross section of the road grader taken generally along line 10—10 in FIG. 4.

Associated tie rods 40 and torque tubes 46 are rigidly connected at their ends to respective hinge pins 37 by the collars 38, 39 whereby they are maintained in parallel, vertically spaced relationship. Associated tie rods 40, torque tubes 46, collars 38 and 39, and hinge pin pairs 37 thus interconnected form rectangular first, second, third and fourth subframes 61, 62, 63 and 64. The third subframe 63 includes diagonal braces 65 (FIG. 10) connected to the tie rod 40 and the torque tube 46 at locations spaced slightly inwardly from the hinge pins 37. The diagonal braces 65 function to maintain the subframes 61–64, and particularly the third subframe 63, in rectangular configurations and to resist racking and twisting forces acting on the frame 2 about its longitudinal axis.

The tongue assembly 4 includes a tongue 73 extending generally along the longitudinal axis of the grader 1 with front and back ends 74, 75. The tongue 73 comprises a rectangular tube 76 with a hitch clevis 77 on the tongue front end 74 for connection to a tractor or tow vehicle (not shown) and a tongue mounting clevis 78 mounted on the tube 76 at the tongue back end 75.

Figure 5:
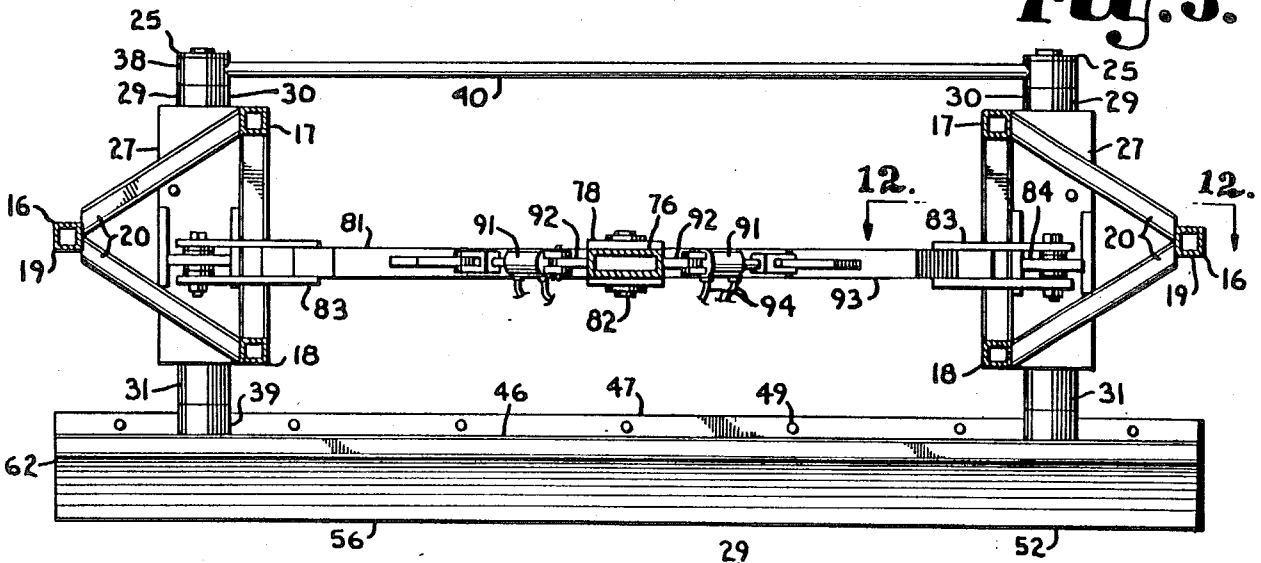
FIG. 5 is a vertical cross section of the road grader taken generally along line 5—5 in FIG. 1.

The tongue 73 is pivotally attached to a cross-bar 81 (FIG. 5) extending between the trusses 16 in front of the second subframe 62 by a tongue mounting bolt 82. The cross-bar 81 includes clevis ends 83 pivotally bolted to cross-bar mounting ears 84 extending forwardly from the hinge assemblies 25 at the second subframe 62. The cross-bar 81, in conjunction with the rectangular subframes 61–64, helps to maintain the trusses 16 in parallel, spaced relation.

Figure 7:
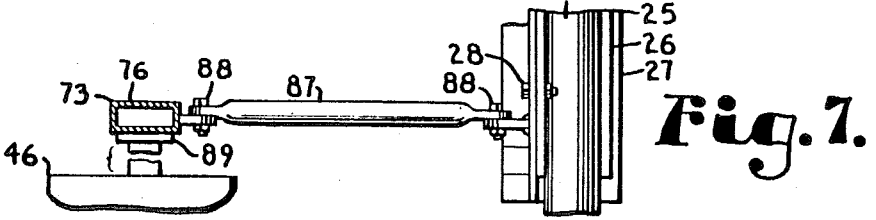
FIG. 7 is a vertical cross section of the road grader taken generally along line 7—7 in FIG. 1.

A pivot bar 87 (FIG. 7) is attached to a hinge assembly 25 at the first subframe 61 and to the tongue tube 76 by ball and socket connections 88 at its opposite ends. The pivot bar 87 centers the tongue 73 within the first subframe 61 and aligns it with the grader longitudinal axis and direction of travel. The ball and socket connections 88 allow for limited movement of the pivot bar 87 from the horizontal so that the tongue 73 can float to a limited extent in a vertical plane. Such vertical tongue movement might result, for example, from relative dislocation between the grader 1 and a tow vehicle caused by changing road surface elevations. A tongue stop 89 extends upwardly from the torque tube 46 of the first blade assembly 11 and provides a lower limit to the vertical travel of the tongue 73.

A pair of linear motors comprising double-acting hydraulic power cylinders 91 are provided for skewing the frame 2. Each hydraulic cylinder 91 is pivotally connected to a cylinder mounting ear 92 on a respective side of the tongue tube 76 and to a cylinder mounting bar 93 extending forwardly from the cross-bar 81. Hydraulic lines 94 communicate the cylinders 91 with a source (not shown) of pressurized hydraulic fluid which may be located, for 14 example, on the tow vehicle.

Figure 9:
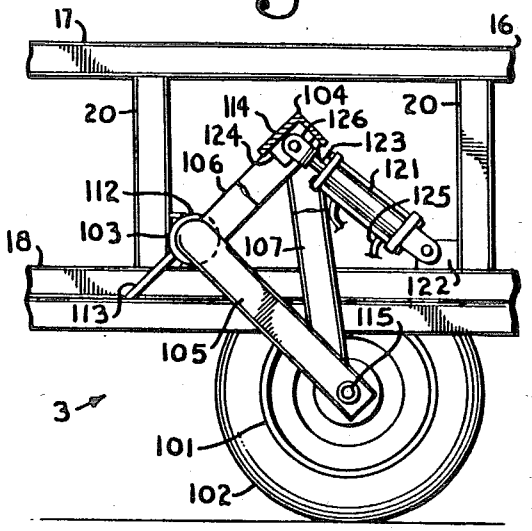
FIG. 9 is a fragmentary side elevation of the road grader particularly showing a transport wheel assembly.

Each transport wheel assembly 3 includes a pair of wheels 101 with tires 102 and wheel carriages 103 for extending and retracting the wheel carriages 103 between lowered and raised positions. Each wheel carriage 103 includes a pair of triangular wheel carriage subframes 104 comprising base, vertical and hypotenuse members 105, 106 and 107 (FIG. 9). A wheel carriage tube 111 (FIG. 1) interconnects the subframes 104 at the intersections of their base and vertical members and is rotatably received within a wheel carriage bushing 112 welded to a respective lower rail 18 and a chord 20. The wheel carriage bushing 112 connections with the truss 16 are reinforced with triangular gussets 113. The subframes 104 are interconnected at the intersections of their vertical and hypotenuse members 106, 107 by a cylinder mounting beam 114. At the intersections of their base and hypotenuse members 105 and 107, axles 115 are attached to the subframes 104 for mounting the wheels 101.

A pair of linear motors comprising double-acting hydraulic power cylinders 121 are provided for extending and retracting the wheel assemblies 3. Each cylinder 121 is pivotally connected at one end to a cylinder mounting ear 122 welded to a respective lower rail 18 and a chord 20. A cylinder rod 123 includes clevis end 126 which is pivotally connected to a tab 124 positioned in the cylinder mounting beam 114. Hydraulic lines 125 communicate the hydraulic cylinders 121 with the source of pressurized hydraulic fluid.

Figure 4:
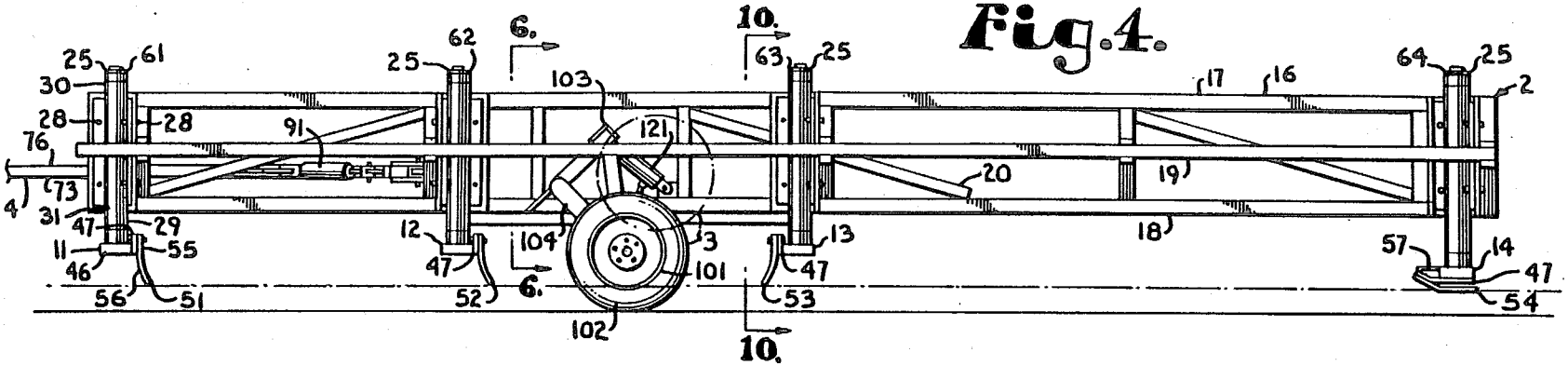
FIG. 4 is a side elevation of the road grader.
Figure 6:
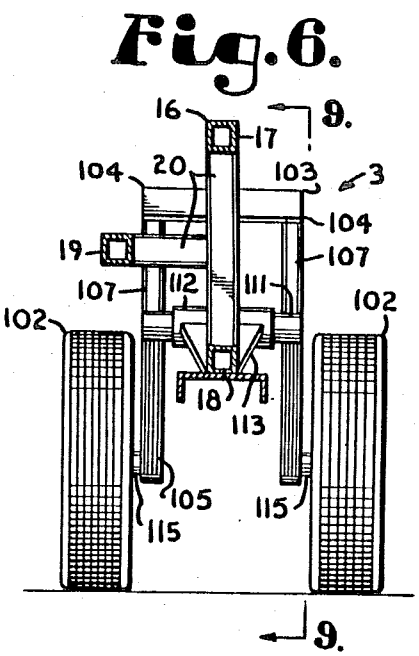
FIG. 6 is a vertical cross section of the road grader taken generally along line 6—6 in FIG. 4.

In operation, the road grader 1 may be transported to a work location by extending (lowering) the transport wheel assemblies 3. As shown in FIG. 4, the axles 115 of the transport wheels 101 are positioned forwardly of the transverse center line of the frame 2 so that the road grader 1 is tail-heavy in its transport position. The tongue 73 is attached to a tow vehicle and because the grader 1 is tail-heavy, the tongue 73 rests on the tongue stop 89.

Figure 2:
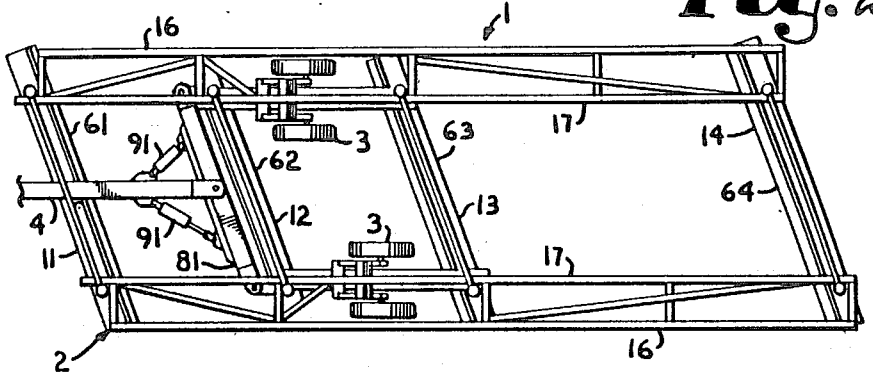
FIG. 2 is a top plan of the road grader in a first skewed configuration.

The transport wheel assemblies 3 are retracted by extending the hydraulic cylinders 121 so that the wheels 101 are positioned above the level of the blades 51–54. The grader 1 is then skewed with the frame skewing cylinders 91. The hydraulic system causes one of the cylinders 91 to extend as the other retracts and vice versa so that the frame 2 is skewed to either of the configurations shown in FIGS. 2 and 3 whereby excess road material is strewn laterally to the left or right. Thus, the operator can selectively determine which side of the grader 1 is to receive the excess material therefrom.

The functions of the blades 51–54 may be altered by reversing their orientations. For example, the second blade 52 is shown in a scraper orientation. However, by reversing it so that its distal leg 56 extends in the direction of travel it will function as a cutter. The elongated slots 32 allow for adjusting the working depths of the blades 51–54. Vertical adjustments are accomplished by loosening the depth adjustment bolts 28, shifting the angle members 26, 27 vertically with respect to each other and retightening the bolts 28 with the blade properly repositioned. Such working depth adjustments may be required to compensate, for example, for differential wear in respective blades 51–54.

Referring to FIGS. 13–16, a hydraulic lift mechanism 200 for varying the vertical position of one of the blades of the grader 1 is illustrated. The lift mechanism 200 is particularly applicable to a cutter blade assembly 201 including a cutter blade 202, corresponding to the cutter blade assembly 13 and cutter blade 53 of the embodiment illustrated in FIGS. 1–12. The cutter blade assembly 201 includes a cross member or torque tube 203 which pivotally connects between the side trusses 204 and 205 of the grader frame 206. The cross member 203 has a pair of upstanding members or standards 207 which are sleeved within support tubes 208. The standards 207 are intended to be rotatable and slidable within the tubes 208 and include an upper collar 209 and a lower collar 210 to limit respectively the downward and upward movement of the standards 207 within the support tubes 208. The tubes 208 are attached to the trusses 204 and 205 as by welding to an inner angle 211 which is slidably attached to an outer angle 212 affixed to the side trusses.

Figure 16:
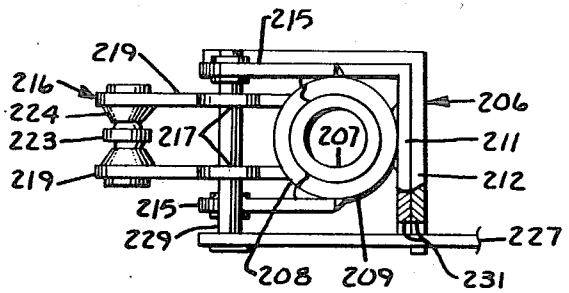
FIG. 16 is a plan view taken on line 16—16 of FIG. 13 and illustrates details of the lift mechanism.

The upper collars 209 have outwardly extending rocker mounting ears 215 on which rocker members 216 are pivotally mounted. Each rocker member 216 is formed of spaced apart parallel rocker components which act in unison The rocker members are "T" shaped and each includes an upper leg 217, a lower leg 218, and a side leg 219. A pair of anchor ears 222 extends outwardly from each of the support tubes 208. An anchor link 223 is pivotally connected between each set of side legs 219 and anchor ears 222. Because it is desired that the grader frame 206 be skewable to orient the grader blades diagonally, the joints between the anchor links 223 and the anchor ears 222 and side legs 219 are ball socket joints 224 (FIG. 16). This allows pivoting about horizontal axes for the lifting motion and about vertical axes for the skewing motion.

A pair of scissor arms 227 and 228 are pivotally connected between the left and right rocker members 216 in crossed fashion. That is, each scissor arm extends between the upper leg 217 of one rocker member and the lower leg 218 of the other rocker member. The pivot pins 229 which connect one of the scissor arms, for example, arm 227 to the rocker members 216 are longer than for the other arm 228 to provide sufficient clearance between the arms. A blade lift hydraulic ram 230 is pivotally connected between the scissor arms 227 and 228. When the ram 230 is extended (FIG. 14), the upper legs 217 are pivoted inwardly, thereby pivoting the side legs 219 upwardly. Because of the anchoring effect of the links 223 and the ears 222, this causes the blade assembly 201 to be lowered. When the ram 230 is retracted (FIG. 15), the blade assembly 201 is raised. The blade assembly 201 may also assume positions between the upper and lower extremes. Preferably, the supply and return of hydraulic fluid to the ram 230 is controlled by solenoid valves (not shown) to minimize the routing of hydraulic hoses (not shown). Depending on the dimensions of the angles 211 and 212, it might be necessary to form cutouts 231 therein to clear the scissor arms 227 and 228.

Figure 17:
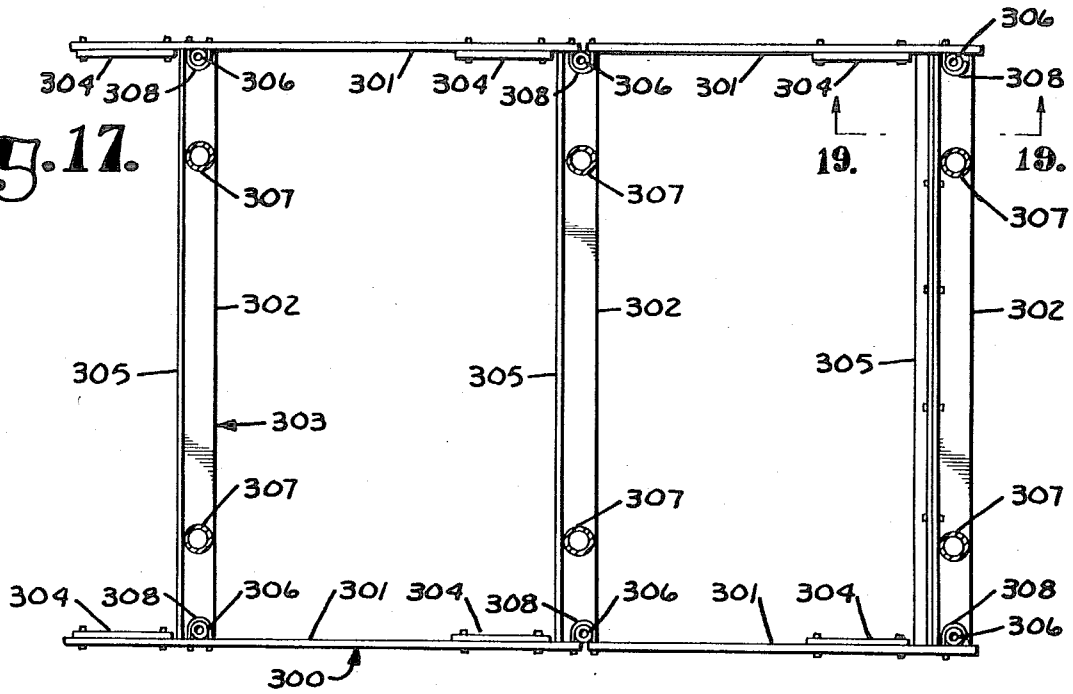
FIG. 17 is a fragmentary plan view of a grader frame and illustrates a mounting structure for road material deflector plates associated with the grader blades.
Figure 19:
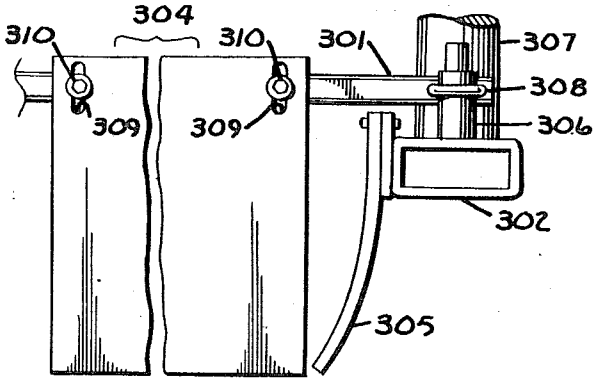
FIG. 19 is an enlarged side elevational view of one the deflector plates.
Figure 18:
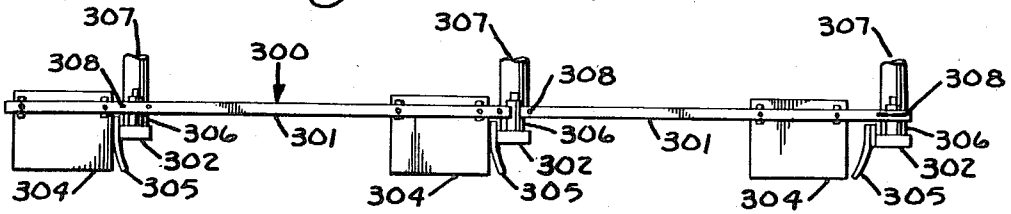
FIG. 18 is a fragmentary side elevational view of the deflector plates and mounting structure.

Referring to FIGS. 17–19, a deflector plate mounting structure 300 is illustrated. The structure 300 includes a plurality of stringers or plate mounting bars 301 pivotally connected to cross members or torque tubes 302 of a road grader frame 303 and a pair of deflector plates 304 associated with each blade 305 mounted on the cross members 302. The deflector plates 304 are provided to control the lateral dispersal of road material removed from a road surface. Each cross member 302 includes a pair of pivot posts 306 positioned outboard of the frame hinge posts 307 which correspond to the hinge assemblies 25 of the road grader 1. The stringers 301 are connected to the pivot posts by U-bolts 308.

In cases where it is desirable to provide a lift mechanism for varying the height of a blade 305, the stringers 301 may be separated for pivoting about the legs of the U-bolts 308, as is shown at the middle cross member 302 in FIGS. 17 and 18. The pivot posts 306 and U-bolts 308 allow the deflector plates 304 to maintain their relative positions with respect to the associated blades 305 when the grader frame 303 is skewed to orient the blades 305 diagonally. The deflector plates 304 are preferably provided with slots 309 for adjustably attaching the plates to the stringers 301 by bolts 310.

It is to be understood that while certain forms of the present invention have been illustrated and described herein, it is not to be limited to the specific forms or arrangement of parts described and shown.

What is claimed and desired to be secured by Letters Patent is as follows:

1. A road grader scraper blade lift mechanism comprising:

(a) a road grader frame having a front end, a rear end, and opposite sides;

(b) an elongated road grader blade including a pair of spaced apart blade standards upstanding from said blade;

(c) a pair of blade supports positioned in axially vertical orientation and in laterally spaced relation on said grader frame;

(d) one of said pair of blade standards and said pair of blade supports being tubular and slidably receiving the other of said pairs respectively therein;

(e) a pair of rocker members pivotally connected respectively to one of said pair of blade standards and said pair of blade supports, each rocker member including a top leg, a bottom leg, and a side leg;

(f) a pair of anchor links pivotally connected respectively between said side legs to said rocker members and said grader frame;

(g) a pair of crossed scissor arms pivotally connected respectively from the upper leg of each rocker member to the lower leg of the other rocker member; and (h) an extendible ram pivotally connected between said scissor arms whereby upon the extension and retraction of said ram said blade is moved vertically.

2. A mechanism as set forth in claim 1 wherein:

(a) said blade supports are tubular and have said blade standards received respectively therein; and (b) said rocker members are pivotally connected respectively to said blade standards.

3. A mechanism as set forth in claim 2 including:

(a) a pair of road surface material deflector plates connected to said grader frame and positioned at opposite ends of said blade.

4. A mechanism as set forth in claim 2 wherein:

(a) said grader frame includes a pair of elongated, spaced apart, and substantially parallel side members pivotally interconnected by at least two cross members;

(b) said blade supports are cylindrical and are positioned respectively on said side members;

(c) said blade standards are cylindrical; and (d) said anchor links are connected respectively to said side legs and said side members by respective ball sockets whereby said frame may be selectively skewed in a parallelogram manner to orient said blade diagonally with respect to said side members.

5. A mechanism as set forth in claim 4 including:

(a) a pair of elongated plate support rods pivotally connected to said cross members in parallel relation respectively to said side members; and (b) a pair of road surface material deflector plates connected respectively to said rods at opposite ends of said blade.

6. A mechanism as set forth in claim 2 including:

(a) an upper collar on each blade standard at an upper end thereof to limit the downward movement of said standard with respect to the associated blade support; and (b) a lower collar on each blade standard at a lower end thereof to limit the upward movement of said standard with respect to said associated blade support.

7. A mechanism as set forth in claim 2 wherein:

(a) each blade standard has a pair of spaced apart pivot ears extending substantially laterally of said grader frame from an upper end of said standard;

(b) each rocker member includes a pair of similarly shaped rocker components positioned in spaced apart relation and connected to said pivot ears to pivot in unison;

(c) each blade support has a pair of spaced apart anchor ears extending substantially laterally of said grader frame; and (d) each anchor link is pivotally connected to said anchor ears by an anchor ball socket and to the side legs of said rocker components by a rocker ball socket.

8. A mechanism as set forth in claim 7 wherein:

(a) said scissor arms are connected to said rocker members by respective scissor arm pins; and (b) the scissor arm pins associated with one of said scissor arms are longer than the pins associated with the other scissor arm to provide clearance between said scissor arms.

9. A drag type road grader mechanism comprising:

(a) a road grader frame including a pair of elongated, laterally spaced, and substantially parallel side members pivotally interconnected by a plurality of cross members;

(b) one of said cross members including a pair of cylindrical blade standards upstanding therefrom;

(c) a pair of cylindrical, tubular blade supports positioned respectively on said side members and having said blade standards slidably and rotatably received therein to pivotally connect said one of said cross members to said side members;

(d) an elongated road grader blade positioned on said one of said cross members;

(e) a pair of rocker members pivotally connected respectively to said blade standards, each rocker member including a top leg, a bottom leg, and a side leg;

(f) a pair of anchor links pivotally connected respectively between said side legs of said rocker members and the associated side member of said grader frame;

(g) a pair of crossed scissor arms pivotally connected respectively from the upper leg of each rocker member to the lower leg of the other rocker member;

(h) an extendible blade lift ram pivotally connected between said scissor arms whereby upon the extension and retraction of said ram said blade is moved vertically;

(i) hitch means pivotally connected to said front cross member to connect said mechanism to a tow vehicle; and (j) an extendible frame skew ram pivotally connected between said hitch means and a front cross member of said cross members and selectively operable to skew said frame in a parallelogram manner to orient said blade diagonally with respect to said side members.

10. A mechanism as set forth in claim 9 including:

(a) a pair of elongated plate support rods pivotally connected to said cross members in parallel relation respectively to said side members; and (b) a pair of road surface material deflector plates connected respectively to said rods at opposite ends of said blade.

11. A mechanism as set forth in claim 9 including:

(a) an upper collar on each blade standard at an upper end thereof to limit the downward movement of said standard with respect to the associated blade support; and (b) a lower collar on each blade standard at a lower end thereof to limit the upward movement of said standard with respect to said associated blade support.

12. A mechanism as set forth in claim 9 wherein:

(a) each blade standard has a pair of spaced apart pivot ears extending substantially laterally of said grader frame from an upper end of said standard;

(b) each rocker member includes a pair of similarly shaped rocker components positioned in spaced apart relation and connected to said pivot ears to pivot in unison;

(c) each blade support has a pair of spaced apart anchor ears extending substantially laterally of said grader frame; and (d) each anchor link is pivotally connected to said anchor ears by an anchor ball socket and to the side legs of said rocker components by a rocker ball socket.

13. A mechanism as set forth in claim 12 wherein:

(a) said scissor arms are connected to said rocker members by respective scissor arm pins; and (b) the scissor arm pins associated with one of said scissor arms are longer than the pins associated with the other scissor arm to provide clearance between said scissor arms.

14. A drag-type road grader mechanism comprising:

(a) a road grader frame including a pair of side member pivotally interconnected by at least two cross members and means to skew said frame by varying the angular relationship of said cross members to said side members;

(b) an elongated road grader blade positioned on said frame to engage a road surface;

(c) hitch means connected to said frame to connect same to a tow vehicle;

(d) a pair of road surface material deflector plates positioned at opposite ends of said blade to control the lateral dispersal of road material by said blade;

(e) said blade being pivotally connected to said side members whereby said blade is oriented diangonally with respect to said side members when said frame is skewed;

(f) a pair of deflector plates support posts pivotally connected to said cross members on opposite sides of said frame; and (g) said deflector plates being mounted respectively on said support posts at opposite ends of said blade.

15. A drag-type road grader mechanism comprising:

(a) a road grader frame including a pair of side members pivotally interconnected by at least two cross members and means to skew said frame by varying the angular relationship of said cross members to said side members;

(b) an elongated road grader blade positioned on said frame to engage a road surface;

(c) hitch means connected to said frame to connect same to a tow vehicle;

(d) a pair of road surface material deflector plates positioned at opposite ends of said blade to control the lateral dispersal of road material by said blade;

(e) said blade being mounted on one of said cross members;

(f) the vertical position of said blade with respect to said frame being variable;

(g) a pair of deflector supports posts pivotally connected to said cross members for pivoting about substantially vertical axes; and (h) said deflector plates being mounted respectively on said support posts.

16. A drag-type road grader mechanism comprising:

(a) a road grader frame including a pair of side members pivotally interconnected by at least two cross members and means to skew said frame by varying the angular relationship of said cross members to said side members;

(b) an elongated road grader blade positioned on said frame to engage a road surface;

(c) hitch means connected to said frame to connect same to a tow vehicle;

(d) a pair of road surface material deflector plates positioned at opposite ends of said blade to control the lateral dispersal of road material by said blade;

(e) said frame including:

(1) a pair of trusses aligned in parallel relation along a direction of travel of said grader;

(2) a plurality of hinge mechanism mounted in longitudinally spaced spaced relationship on each said truss, each said hinge mechanism being positioned in transversely opposed relationship with an associated hinge mechanism on the other of said trusses; and (3) a plurality of tie rod means each extending transversely between said trusses and interconnecting an associated pair of said hinge mechanisms;

(f) a plurality of road-working blades extending transversely between said trusses;

(g) a plurality of blade mounting means each mounting a respective blade on an associated pair of hinge mechanisms;

(h) a tongue assembly including a tongue extending forwardly from said frame along the direction of vehicle travel and tongue connector means adapted for connecting said tongue assembly to said trusses;

(i) a pair of transport wheel assemblies each being movable between a retracted position with the grader in an operating mode and an extended position with a grader in transport mode, each said wheel assembly being mounted on a respective truss;

(j) power means for skewing said frame whereby said trusses are shifted longitudinally with respect to each other and said blades are angle with respect to the direction of grader travel;

(k) means adapted for raising and lowering said wheel assembly; and (1) each said hinge mechanism pivotally mounting in spaced relation a respective tie rod means and blade for pivotal movement with respect to a respective truss about a vertical pivotal axis extending through said hinge mechanism.

* * * * *